US007433775B2

(12) United States Patent
Livshiz et al.

(10) Patent No.: US 7,433,775 B2
(45) Date of Patent: Oct. 7, 2008

(54) ENGINE TORQUE CONTROL AT HIGH PRESSURE RATIO

(75) Inventors: Michael Livshiz, Ann Arbor, MI (US); Jeffrey M. Kaiser, Highland, MI (US); Bahram Younessi, Farmington, MI (US); Richard B. Jess, Haslett, MI (US); Richard H. Clutz, Howell, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 11 days.

(21) Appl. No.: 11/656,929

(22) Filed: Jan. 23, 2007

(65) Prior Publication Data

US 2008/0120009 A1 May 22, 2008

Related U.S. Application Data

(60) Provisional application No. 60/860,010, filed on Nov. 17, 2006.

(51) Int. Cl.
*F02D 28/00* (2006.01)

(52) U.S. Cl. ..... 701/102; 123/361; 123/406.23

(58) Field of Classification Search ..... 701/102, 701/103, 101, 115, 84, 104, 105, 110; 123/361, 123/363, 399, 677, 478, 480, 406.23
See application file for complete search history.

(56) References Cited

U.S. PATENT DOCUMENTS

| | | | | |
|---|---|---|---|---|
| 6,016,460 | A * | 1/2000 | Olin et al. | 701/102 |
| 6,366,847 | B1 * | 4/2002 | Sun et al. | 701/103 |
| 6,386,351 | B1 * | 5/2002 | Salecker et al. | 192/54.1 |
| 6,652,415 | B2 * | 11/2003 | Segawa et al. | 477/62 |
| 6,704,638 | B2 | 3/2004 | Livshiz et al. | |
| 6,816,771 | B2 * | 11/2004 | Miura et al. | 701/102 |
| 6,840,215 | B1 | 1/2005 | Livshiz et al. | |
| 6,920,865 | B2 * | 7/2005 | Lyon | 123/399 |
| 7,000,589 | B2 * | 2/2006 | Matthews et al. | 123/350 |
| 7,092,813 | B2 * | 8/2006 | Abe et al. | 701/104 |
| 7,305,967 | B1 * | 12/2007 | Hagari et al. | 123/403 |

* cited by examiner

*Primary Examiner*—Willis R. Wolfe, Jr.
*Assistant Examiner*—Johnny H. Hoang

(57) ABSTRACT

A method of controlling a torque output of an internal combustion engine includes determining a pressure ratio, determining a reference torque based on the pressure ratio and a torque request, calculating a desired throttle area based on the reference torque and regulating operation of the engine based on the desired throttle area to achieve the desired torque.

20 Claims, 3 Drawing Sheets

ENGINE TORQUE CONTROL AT HIGH PRESSURE RATIO

CROSS-REFERENCE TO RELATED APPLICATIONS

This application claims the benefit of U.S. Provisional Application No. 60/860,010, filed on Nov. 17, 2006. The disclosure of the above application is incorporated herein by reference.

FIELD

The present invention relates to engines, and more particularly to engine torque control while the engine is operating at a high pressure ratio.

BACKGROUND

Internal combustion engines combust an air and fuel mixture within cylinders to drive pistons, which produces drive torque. Air flow into the engine is regulated via a throttle. More specifically, the throttle adjusts throttle area, which increases or decreases air flow into the engine. As the throttle area increases, the air flow into the engine increases. A fuel control system adjusts the rate that fuel is injected to provide a desired air/fuel mixture to the cylinders. As can be appreciated, increasing the air and fuel to the cylinders increases the torque output of the engine.

Engine control systems have been developed to accurately control engine torque output to achieve a desired engine speed, particularly when operating under high pressure ratios. Traditional engine control systems, however, do not control the engine speed as accurately as desired. Further, traditional engine control systems do not provide as rapid of a response to control signals as is desired or coordinate engine torque control among various devices that affect engine torque output. Such traditional control systems are often more complex than desired and require time and cost intensive calibration processes.

SUMMARY

Accordingly, the present disclosure provides a method of controlling a torque output of an internal combustion engine. The method includes determining a pressure ratio, determining a reference torque based on the pressure ratio and a torque request, calculating a desired throttle area based on the reference torque and regulating operation of the engine based on the desired throttle area to achieve the desired torque.

In other features, the method further includes calculating a desired manifold absolute pressure (MAP) of the engine based on the reference torque and calculating a desired air-per-cylinder (APC) of the engine based on the reference torque. The desired throttle area is calculated based on the desired MAP and the desired APC. The desired MAP is determined using an inverted MAP-based torque model and the desired APC is determined using an inverted APC-based torque model. The method further includes filtering the desired MAP based on the pressure ratio and on whether the engine is operating in a steady-state. The method further includes determining a desired mass air flow (MAF) based on the desired APC. The desired throttle area is calculated based on the desired MAF.

In other features, the method further includes determining an estimated torque of the engine and correcting the reference torque based on the estimated torque, the pressure ratio and on whether the engine is operating in a steady-state. The method further includes calculating a torque error based on the reference torque and the estimated torque. The reference torque is corrected based on the torque error.

In another feature, the method further includes determining whether the engine is operating in a steady-state based on the pressure ratio and an engine RPM. The desired throttle area is calculated based on whether the engine is operating in the steady-state.

In still another feature, the method further includes rate limiting the reference torque.

In yet another feature, the method further includes calculating the pressure ratio as a ratio between a MAP and a barometric pressure.

Further advantages and areas of applicability of the present disclosure will become apparent from the detailed description provided hereinafter. It should be understood that the detailed description and specific examples, while indicating an embodiment of the disclosure, are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
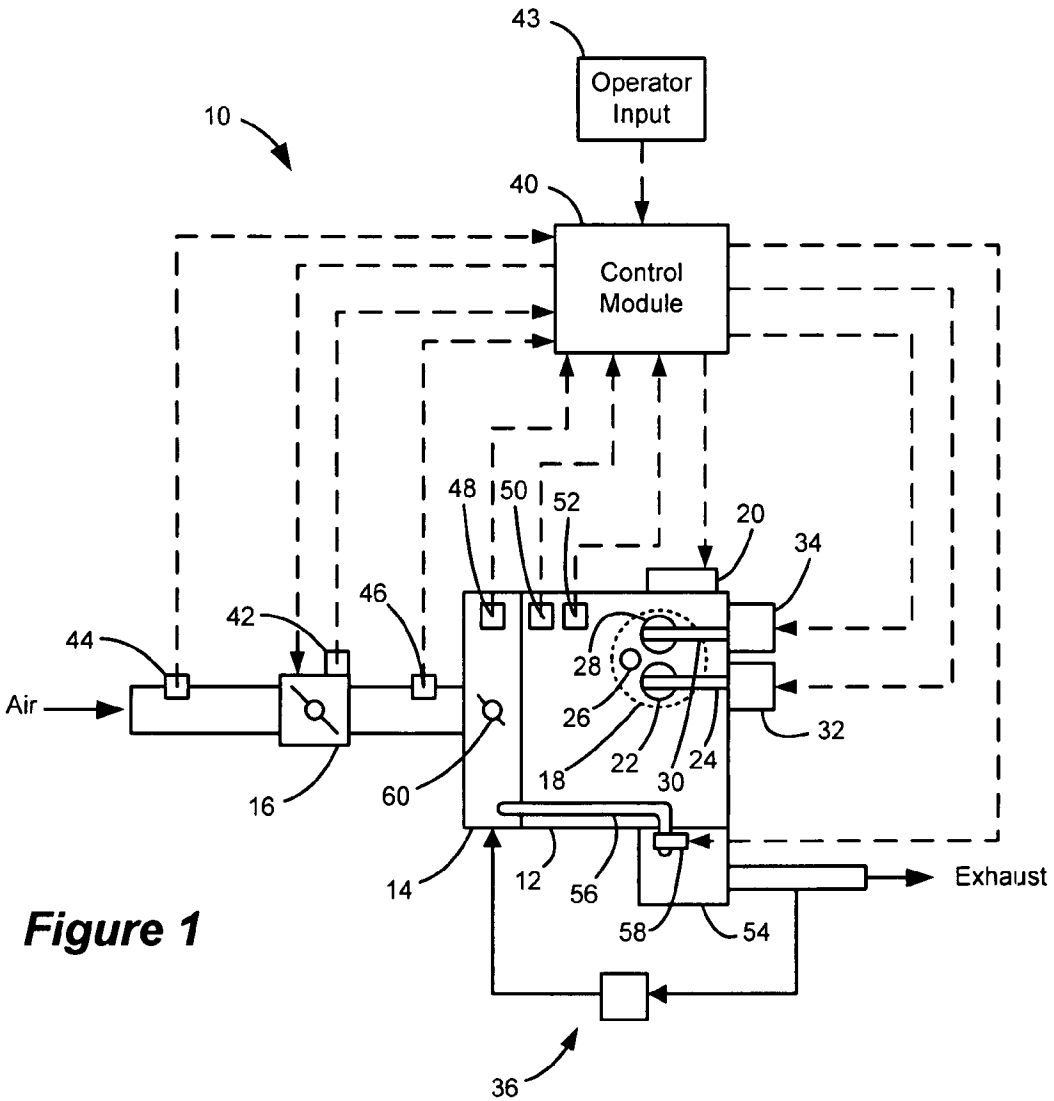
FIG. 1 is a schematic illustration of an exemplary engine system according to the present disclosure.

The following description is merely exemplary in nature and is in no way intended to limit the disclosure, its application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, or other suitable components that provide the described functionality.

Referring now to FIG. 1, an engine system 10 includes an engine 12 that combusts an air and fuel mixture to produce drive torque. Air is drawn into an intake manifold 14 through a throttle 16. The throttle 16 regulates mass air flow into the intake manifold 14. Air within the intake manifold 14 is distributed into cylinders 18. Although a single cylinder 18 is illustrated, it can be appreciated that the coordinated torque control system of the present invention can be implemented in engines having a plurality of cylinders including, but not limited to, 2, 3, 4, 5, 6, 8, 10 and 12 cylinders.

A fuel injector (not shown) injects fuel that is combined with the air as it is drawn into the cylinder 18 through an intake port. The fuel injector may be an injector associated with an electronic or mechanical fuel injection system 20, a jet or port of a carburetor or another system for mixing fuel with intake air. The fuel injector is controlled to provide a desired air-to-fuel (A/F) ratio within each cylinder 18.

An intake valve 22 selectively opens and closes to enable the air/fuel mixture to enter the cylinder 18. The intake valve position is regulated by an intake cam shaft 24. A piston (not shown) compresses the air/fuel mixture within the cylinder 18. A spark plug 26 initiates combustion of the air/fuel mixture, which drives the piston in the cylinder 18. The piston, in turn, drives a crankshaft (not shown) to produce drive torque. Combustion exhaust within the cylinder 18 is forced out an exhaust port when an exhaust valve 28 is in an open position. The exhaust valve position is regulated by an exhaust cam shaft 30. The exhaust is treated in an exhaust system and is released to atmosphere. Although single intake and exhaust valves 22,28 are illustrated, it can be appreciated that the engine 12 can include multiple intake and exhaust valves 22,28 per cylinder 18.

The engine system 10 can include an intake cam phaser 32 and an exhaust cam phaser 34 that respectively regulate the rotational timing of the intake and exhaust cam shafts 24, 30. More specifically, the timing or phase angle of the respective intake and exhaust cam shafts 24, 30 can be retarded or advanced with respect to each other or with respect to a location of the piston within the cylinder 18 or crankshaft position. In this manner, the position of the intake and exhaust valves 22,28 can be regulated with respect to each other or with respect to a location of the piston within the cylinder 18. By regulating the position of the intake valve 22 and the exhaust valve 28, the quantity of air/fuel mixture ingested into the cylinder 18 and therefore the engine torque is regulated.

The engine system 10 can also include an exhaust gas recirculation (EGR) system 36. The EGR system 36 includes an EGR valve 38 that regulates exhaust flow back into the intake manifold 14. The EGR system is generally implemented to regulate emissions. However, the mass of exhaust air that is circulated back into the intake manifold 14 also affects engine torque output.

A control module 40 operates the engine based on the torque-based engine control of the present disclosure. More specifically, the control module 40 generates a throttle control signal and a spark advance control signal based on a desired engine speed ($RPM_{DES}$). A throttle position signal generated by a throttle position sensor (TPS) 42. An operator input 43, such as an accelerator pedal, generates an operator input signal. The control module 40 commands the throttle 16 to a steady-state position to achieve a desired throttle area ($A_{THRDES}$) and commands the spark timing to achieve a desired spark timing ($S_{DES}$). A throttle actuator (not shown) adjusts the throttle position based on the throttle control signal.

An intake air temperature (IAT) sensor 44 is responsive to a temperature of the intake air flow and generates an intake air temperature (IAT) signal. A mass airflow (MAF) sensor 46 is responsive to the mass of the intake air flow and generates a MAF signal. A manifold absolute pressure (MAP) sensor 48 is responsive to the pressure within the intake manifold 14 and generates a MAP signal. An engine coolant temperature sensor 50 is responsive to a coolant temperature and generates an engine temperature signal. An engine speed sensor 52 is responsive to a rotational speed (i.e., RPM) of the engine 12 and generates in an engine speed signal. Each of the signals generated by the sensors is received by the control module 40.

The engine system 10 can also include a turbo or supercharger 54 that is driven by the engine 12 or engine exhaust. The turbo 54 compresses air drawn in from the intake manifold 14. More particularly, air is drawn into an intermediate chamber of the turbo 54. The air in the intermediate chamber is drawn into a compressor (not shown) and is compressed therein. The compressed air flows back to the intake manifold 14 through a conduit 56 for combustion in the cylinders 18. A bypass valve 58 is disposed within the conduit 56 and regulates the flow of compressed air back into the intake manifold 14.

The engine torque control of the present disclosure determines a desired throttle area ($A_{THRDES}$) based on a pressure ratio ($P_R$), a requested engine torque ($T_{REQ}$) and an estimated engine torque ($T_{EST}$). $T_{REQ}$ is determined based on an operator input including, but not limited to, an accelerator pedal position. $P_R$ is determined as the ratio between MAP and a barometric pressure ($P_{BARO}$). $P_{BARO}$ can be directly measured using a sensor (not shown) or can be calculated using other known parameters. A reference torque ($T_{REF}$) is initially provided by an arbitration ring and is subsequently rate limited based on $P_R$ and $T_{REQ}$ to provide a rate limited $T_{REF}$ ($T_{REFRL}$) By rate limiting $T_{REF}$, undesired, abrupt changes in engine operation are avoided.

$T_{REFRL}$ is summed with a corrected torque error ($T_{ERRCOR}$). More specifically, a torque error ($T_{ERR}$) is determined as the difference between $T_{REFRL}$ and $T_{EST}$. $T_{EST}$ is determined by an engine control module (ECM), as explained in further detail below. $T_{ERRCOR}$ is determined using a proportional-integral function based on the following relationship:

$$T_{ERRCOR}=k_P(P_R)*T_{ERR}+k_1(P_R)*\int T_{ERR} \quad (1)$$

where:

$k_P$ is a pre-determined proportional constant; and $k_I$ is a pre-determined integral constant.

$T_{REFRL}$ is summed with $T_{ERRCOR}$ to provide a corrected reference torque ($T_{REFCOR}$). It should be noted that $T_{ERR}$ is only corrected when the engine is operating in steady-state. If the engine is not operating in steady-state, $T_{ERRCOR}$ is equal to $T_{ERR}$.

Whether the engine is operating in steady-state is determined based on RPM and $T_{REFRL}$. For example, current and previous values are monitored for both RPM and $T_{REFRL}$. These values are filtered and a comparison is made between the respective current and previous values. For example, a current RPM is compared to a previous RPM and a current $T_{REFRL}$ is compared to a previous $T_{REFRL}$. If the differences between the respective values are both less than corresponding threshold differences, the engine is deemed to be operating in steady-state and a steady-state flag ($FLAG_{SS}$) is set equal to 1. If either one of the respective differences is greater than its corresponding threshold difference, the engine is deemed to be operating in a transient state and $FLAG_{SS}$ is set equal to 0.

A desired MAP ($MAP_{DES}$) and a desired air per cylinder ($APC_{DES}$) are determined based on $T_{REFCOR}$. More specifically, $MAP_{DES}$ is determined using an inverse MAP-based torque model in accordance with the following relationship:

$$MAP_{DES}=T_{MAP}^{-1}((T_{REFCOR}+f(\Delta T)), S, I, E, AF, OT, N) \quad (2)$$

where:

$\Delta T$ is a filtered difference between MAP and APC based torque estimators;

S is an ignition timing;

I is an intake valve timing;

E is an exhaust valve timing;

AF is an air-to-fuel ratio;

OT is the engine oil temperature; and

N is the number of cylinders.

The calculation of $\Delta T$ is described in further detail in commonly assigned U.S. Pat. No. 7,069,905, the disclosure of which is expressly incorporated herein by reference. Similarly, $APC_{DES}$ is determined using an inverse APC-based torque model in accordance with the following relationship:

$$APC_{DES}=T_{APC}^{-1}(T_{REFCOR}, S, I, E, AF, OT, N) \quad (3)$$

$MAP_{DES}$ can be filtered to provide a filtered $MAP_{DES}$ ($MAP_{DESF}$). More specifically, $MAP_{DESF}$ is determined based on $P_R$ and SS in accordance with the following relationship:

$$MAP_{FILTD} = \begin{bmatrix} LPF(MAP_{DES}, K_1(P_R), & \text{If} \rightarrow SS = 1 \\ LPF(MAP_{DES}, K_2(P_R), & \text{If} \rightarrow SS = 0 \end{bmatrix} \quad (4)$$

where:

$K_1$ is a pre-determined filter constant;

$K_2$ is a pre-determined filter constant; and

LPF indicates that a low-pass filter is implemented.

A desired MAF ($MAF_{DES}$) is determined based on $APC_{DES}$ in accordance with the following relationship:

$$MAF_{DES} = \frac{APC_{DES} * R}{k_{cyl}} \quad (5)$$

where:

R is the universal gas constant; and $k_{cyl}$ is a constant that is determined based on the number of cylinders (e.g., 15 for an 8-cylinder engine, 20 for a 6-cylinder engine and 30 for a 4-cylinder engine).

$A_{THRDES}$ is subsequently determined based on $MAF_{DES}$ and $MAP_{DESF}$ in accordance with the following relationship:

$$A_{THRDES} = \frac{MAF_{DES} * \sqrt{R * IAT}}{P_{BARO} * \Phi\left(\frac{MAP_{DESF}}{P_{BARO}}\right)} \quad (6)$$

$\Phi$ is based on $P_R$ in accordance with the following relationships:

$$\Phi = \begin{cases} \sqrt{\frac{2\gamma}{\gamma-1}\left(1 - P_R^{\frac{\gamma-1}{\gamma}}\right)} & \text{if } P_R > P_{critical} = \left(\frac{2}{\gamma+1}\right)^{\frac{\gamma}{\gamma+1}} = 0.528 \\ \sqrt{\gamma\frac{2}{\gamma+1}^{\frac{\gamma+1}{(\gamma-1)}}} & \text{if } P_R \leq P_{critical} \end{cases} \quad (7)$$

$P_{CRITICAL}$ is defined as the pressure ratio at which the velocity of the air flowing past the throttle equals the velocity of sound. This condition is called choked or critical flow. The critical pressure ratio is determined by:

$$P_{CRITICAL} = \left(\frac{2}{\gamma+1}\right)^{\frac{\gamma}{\gamma-1}} \quad (8)$$

where $\gamma$ is equal to the ratio of specific heats for air and range from about 1.3 to about 1.4.

Figure 2:
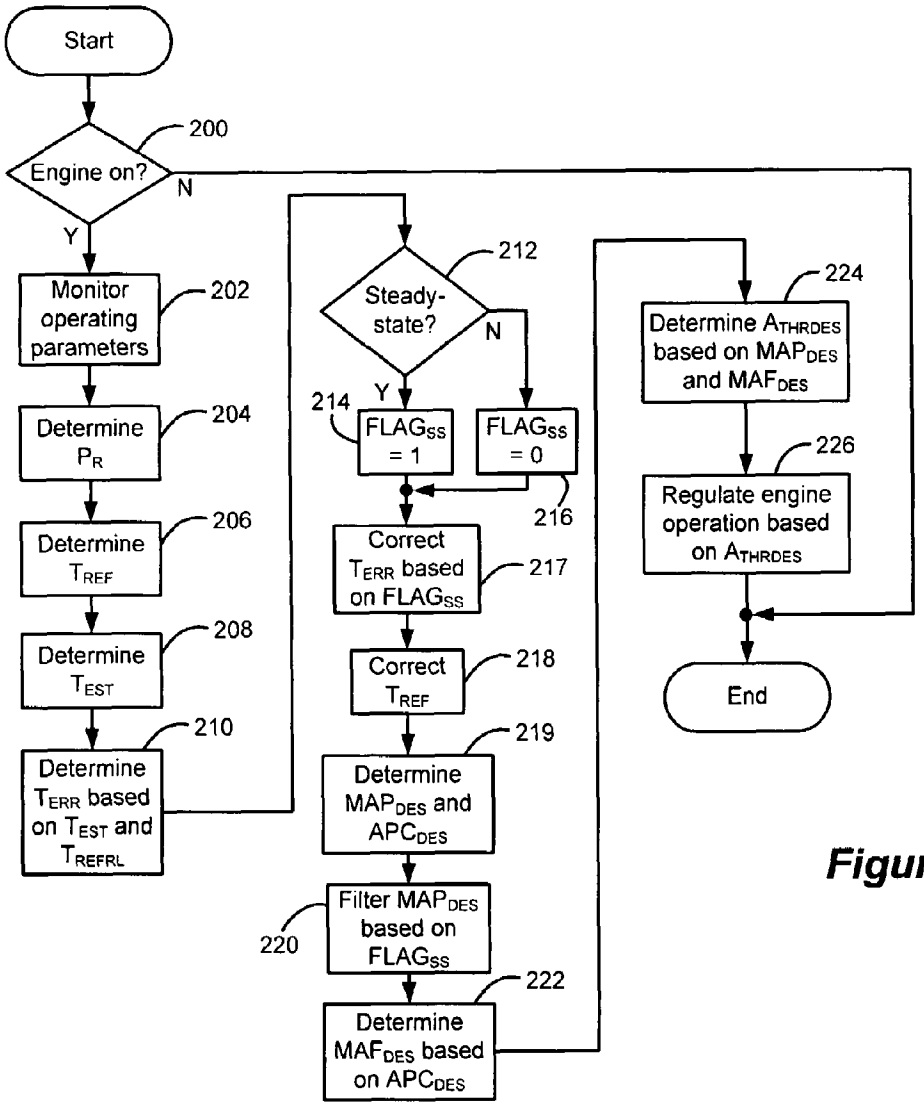
FIG. 2 is a flowchart illustrating steps executed by the engine torque control of the present disclosure.

Referring now to FIG. 2, exemplary steps executed by the engine torque control will be described in detail. In step 200, control determines whether the engine is on. If the engine is not on, control ends. If the engine is one, control monitors the engine operating parameters (e.g., RPM, MAP, MAF, I, E, S, $P_{BARO}$, IAT, etc.) in step 202. In step 204, control determines $P_R$ as the ratio of MAP to $P_{BARO}$. In step 206, control determines $T_{REF}$ based on the above-described rate limiting function using $T_{REQ}$ and $P_R$ as inputs Control determines $T_{EST}$ in step 208. In step 210, control determines $T_{ERR}$ based on $T_{EST}$ and $T_{REFRL}$.

In step 212, control determines whether the engine is operating in steady-state. If the engine is operating in steady-state, control continues in step 214. If the engine is not operating in steady-state, control continues in step 216. In step 214, control sets $FLAG_{SS}$ equal to 1. In step 216, control sets $FLAG_{SS}$ equal to 0. In step 217, control corrects $T_{ERR}$ based on $FLAG_{SS}$, as described above. In step 218, control corrects $T_{REF}$ based on the corrected $T_{ERR}$.

Control determines $MAP_{DES}$ and $APC_{DES}$ based on the corrected $T_{REF}$ in step 219. Control filters $MAP_{DES}$ based on $FLAG_{SS}$, as described in detail above, in step 220. In step 222, control determines $MAF_{DES}$ based on $APC_{DES}$. Control determines $A_{THRDES}$ based on $MAP_{DES}$ and $MAF_{DES}$ in step 224. In step 226, control regulates engine operation based $A_{THRDES}$ and control ends.

Figure 3:
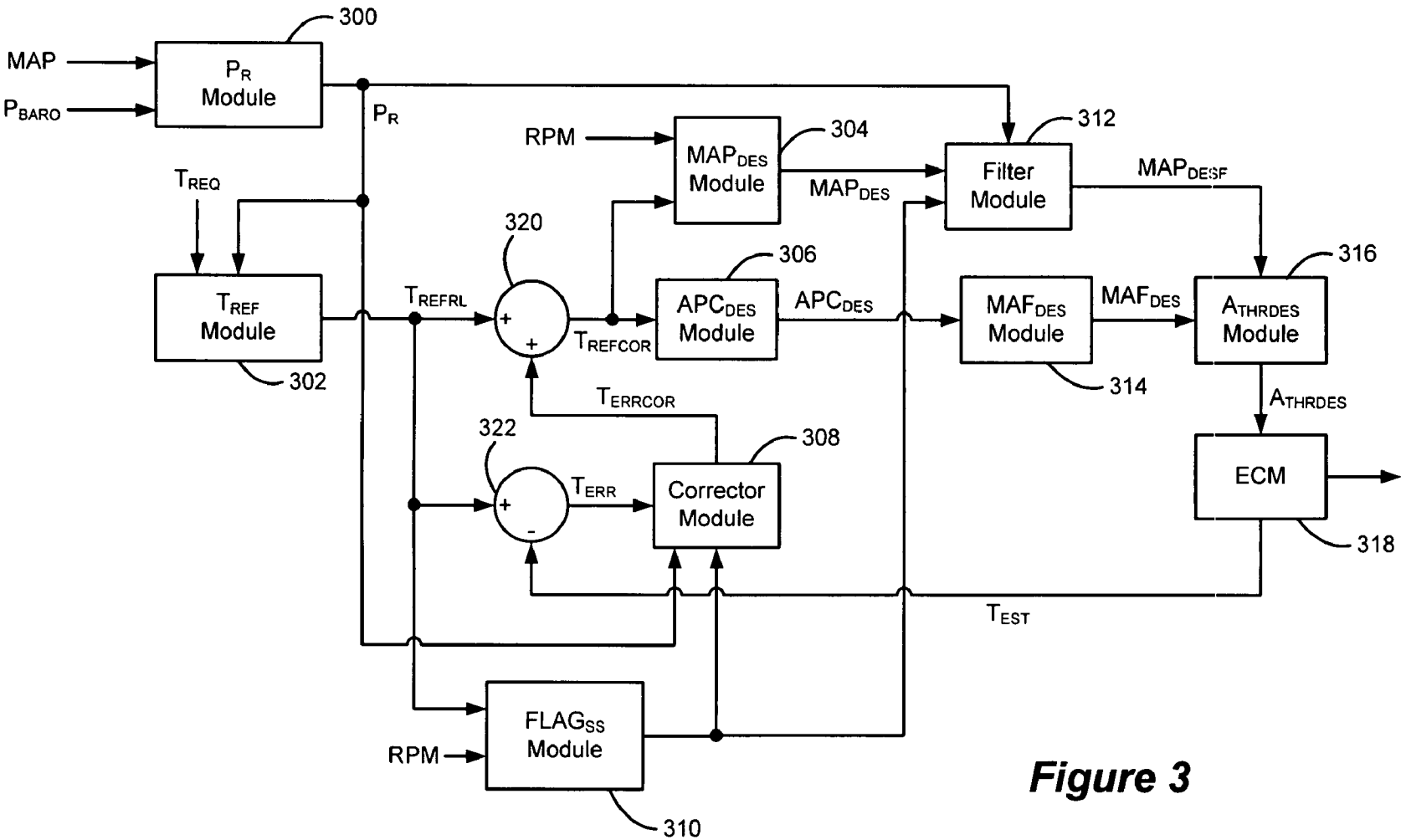
FIG. 3 is a block diagram illustrating exemplary modules that execute the engine torque control of the present disclosure.

Referring now to FIG. 3, exemplary modules that execute the engine torque control will be described in detail. The exemplary modules include a $P_R$ module 300, a $T_{REF}$ module 302, a $MAP_{DES}$ module 304, an $APC_{DES}$ module 306, a corrector module 308, a $FLAG_{SS}$ module 310, a filter module 312, a $MAF_{DES}$ module, an $A_{THRDES}$ module 316 and an ECM 318. Although various modules are described herein, it is anticipated that the individual modules can be combined as sub-modules into a single module or a plurality of modules using various combinations of the modules.

The $P_R$ module 300 determines $P_R$ based on MAP and $P_{BARO}$. $P_R$ is output to the $T_{REF}$ module 302, the corrector module 308 and the filter module 312. The $T_{REF}$ module determines and rate limits $T_{REF}$ (i.e., to provide $T_{REFRL}$) based on $T_{REQ}$ and $P_R$. $T_{REFRL}$ is output to a summer 320, a summer 322 and the $FLAG_{SS}$ module 310. The $FLAG_{SS}$ module 310 determines whether the engine is operating in steady-state and sets $FLAG_{SS}$ accordingly. $FLAG_{SS}$ is output to the corrector module 308 and the filter module 312. The summer 322 inverts $T_{EST}$, which is output from the ECM 318, and sums $T_{REFRL}$ and the inverted $T_{EST}$ to determine $T_{ERR}$. TERR is output to the corrector module 308.

The corrector module 308 selectively corrects $T_{ERR}$ based on $P_R$ and $FLAG_{SS}$, and outputs $T_{ERRCOR}$. More specifically, if $FLAG_{SS}$ indicates that the engine is operating in steady-state, $T_{ERR}$ is corrected, whereby $T_{ERR}$ is not equal to the output $T_{ERRCOR}$. If $FLAG_{SS}$ does not indicate that the engine is operating in steady-state, $T_{ERR}$ is not corrected, whereby $T_{ERR}$ is equal to the output $T_{ERRCOR}$. The summer 320 sums $T_{REFRL}$ and $T_{ERRCOR}$ to provide $T_{REFCOR}$, which is output to the $MAP_{DES}$ module 304 and the $APC_{DES}$ module 306.

The $MAP_{DES}$ module 304 determines $MAP_{DES}$ based on RPM and $T_{REFCOR}$ and outputs $MAP_{DES}$ to the filter module 312. The $APC_{DES}$ module 306 determines $APC_{DES}$ based on $T_{REFCOR}$ and outputs $APC_{DES}$ to the $MAF_{DES}$ module 314. The filter module 312 filters $MAP_{DES}$ based on $FLAG_{SS}$ and $P_R$ to provide $MAP_{DESF}$. The $MAF_{DES}$ module 314 determines $MAF_{DES}$ based on $APC_{DES}$. Both $MAP_{DESF}$ and $MAF_{DES}$ are output to the $A_{THRDES}$ module 316, which determines $A_{THRDES}$ based thereon. $A_{THRDES}$ is output to the ECM 318, which regulates engine operation based thereon.

The engine torque control of the present disclosure provides accurate transient or steady-state torque control under varying environmental conditions by considering the pressure ratio. Traditional systems that don't consider the pressure ratio implement a linear relationship for all pressures. As a result, a high gain is provided for all pressures, which can lead to instability and overshooting in such traditional systems. This accurate engine torque control is achieved under all combinations of engine load, RPM, ignition timing, intake and exhaust timing and the like. Furthermore, the engine torque control enables an automated calibration process to be implemented, which significantly reduces the time and effort required to calibrate an engine. More specifically, the engine torque control is based on a torque model, which unifies all of the inputs and outputs. As a result, the torque model automates the calibration process, wherein an input or inputs can be changed and the effect on the outputs is readily provided.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, the specification and the following claims.

What is claimed is:

1. A method of controlling a torque output of an internal combustion engine, comprising:

determining a pressure ratio;

determining a reference torque based on said pressure ratio and a torque request;

calculating a desired throttle area based on said reference torque; and regulating operation of said engine based on said desired throttle area to achieve said desired torque.

2. The method of claim 1 further comprising:

calculating a desired manifold absolute pressure (MAP) of said engine based on said reference torque; and calculating a desired air-per-cylinder (APC) of said engine based on said reference torque;

wherein said desired throttle area is calculated based on said desired MAP and said desired APC.

3. The method of claim 2 wherein said desired MAP is determined using an inverted MAP-based torque model and said desired APC is determined using an inverted APC-based torque model.

4. The method of claim 2 further comprising filtering said desired MAP based on said pressure ratio and on whether said engine is operating in a steady-state.

5. The method of claim 2 further comprising determining a desired mass air flow (MAF) based on said desired APC, wherein said desired throttle area is calculated based on said desired MAF.

6. The method of claim 1 further comprising:

determining an estimated torque of said engine; and correcting said reference torque based on said estimated torque, said pressure ratio and on whether said engine is operating in a steady-state.

7. The method of claim 6 further comprising calculating a torque error based on said reference torque and said estimated torque, wherein said reference torque is corrected based on said torque error.

8. The method of claim 1 further comprising determining whether said engine is operating in a steady-state based on said pressure ratio and an engine RPM, wherein said desired throttle area is calculated based on whether said engine is operating in said steady-state.

9. The method of claim 1 further comprising rate limiting said reference torque.

10. The method of claim 1 further comprising calculating said pressure ratio as a ratio between a MAP and a barometric pressure.

11. An engine control system for controlling a torque output of an internal combustion engine, comprising:

a first module that determines a pressure ratio;

a second module that determines a reference torque based on said pressure ratio and a torque request;

a third module that calculates a desired throttle area based on said reference torque; and a fourth module that regulates operation of said engine based on said desired throttle area to achieve said desired torque.

12. The engine control system of claim 11 further comprising:

a fifth module that calculates a desired manifold absolute pressure (MAP) of said engine based on said reference torque; and a sixth module that calculates a desired air-per-cylinder (APO) of said engine based on said reference torque;

wherein said desired throttle area is calculated based on said desired MAP and said desired APC.

13. The engine control system of claim 12 wherein said desired MAP is determined using an inverted MAP-based torque model and said desired APC is determined using an inverted APC-based torque model.

14. The engine control system of claim 12 further comprising a seventh module that filters said desired MAP based on said pressure ratio and on whether said engine is operating in a steady-state.

15. The engine control system of claim 12 further comprising a seventh module that determines a desired mass air flow (MAF) based on said desired APC, wherein said desired throttle area is calculated based on said desired MAF.

16. The engine control system of claim 11 wherein said fourth module determines an estimated torque of said engine, and further comprising a fifth module that corrects said reference torque based on said estimated torque, said pressure ratio and on whether said engine is operating in a steady-state.

17. The engine control system of claim 16 further comprising a sixth module that calculates a torque error based on said reference torque and said estimated torque, wherein said reference torque is corrected based on said torque error.

18. The engine control system of claim 11 further comprising a fifth module that determines whether said engine is operating in a steady-state based on said pressure ratio and an engine RPM, wherein said desired throttle area is calculated based on whether said engine is operating in said steady-state.

19. The engine control system of claim 11 further comprising a fifth module that rate limits said reference torque.

20. The engine control system of claim 11 further comprising a fifth module that calculates said pressure ratio as a ratio between a MAP and a barometric pressure.

* * * * *